United States Patent [19]

Ransom

[11] 4,289,258

[45] Sep. 15, 1981

[54] SAFETY CHARGE MEASURING DEVICE FOR CARTRIDGE LOADING MACHINES

[76] Inventor: Charles R. Ransom, C'Arco P.O. Box 308, Highland, Calif. 92346

[21] Appl. No.: 104,137

[22] Filed: Dec. 17, 1979

[51] Int. Cl.[3] ..... F42B 33/02; G01F 11/18

[52] U.S. Cl. ..... 222/308; 222/305; 86/33

[58] Field of Search ..... 222/304–308, 222/440, 438; 86/31, 33

[56] References Cited

U.S. PATENT DOCUMENTS

| | | | |
|---|---|---|---|
| 3,122,278 | 2/1964 | Crozier | 222/305 |
| 3,674,178 | 7/1972 | Pomara, Jr. | 222/308 X |
| 4,175,679 | 11/1979 | Ponce et al. | 222/307 X |

*Primary Examiner*—Charles A. Marmor
*Attorney, Agent, or Firm*—Edward C. Walsh

[57] ABSTRACT

A sliding charge receiver is slidably positioned under a powder feed hopper for receiving a charge from the hopper and delivering it to a feed chute. The sliding member has a hole to receive a powder charge from the hopper. The hole is adjustable in size by a safety adjustment. The hole is formed in the end of a slot. A secondary slider is movable in the slot to adjust the size of the hole. The secondary slider is on a threaded stem within the slot which is threaded through a rotatable bushing or rotor. The stem can be locked in position by an elongated nut that extends through a hole in the end of the sliding member. By releasing the elongated nut, the secondary slider, threaded stem and rotor can be rotated, moving the secondary slider out of the slot so that the secondary slider and stem can be rotated to provide fine adjustments of the position of the secondary slider and of the charge hole in the sliding member with assured safety of the adjustment.

5 Claims, 7 Drawing Figures

SAFETY CHARGE MEASURING DEVICE FOR CARTRIDGE LOADING MACHINES

BACKGROUND OF THE INVENTION

1. Field of the Invention

The field of the invention is primarily, by way of example, that of cartridge loading machines and, more particularly, that part or component of such machines which is the mechanism for receiving and dispensing a measured charge of powder from the hopper and delivering it to a shell casing being loaded. The safety adjustment however may have utilization in their combinations.

2. Description of the Prior Art

U.S. Pat. No. 4,020,737 is a patent of the inventor herein. It shows a loading machine including a mechanism for receiving a measured charge of powder from the hopper and dispensing it to a chute for delivery to a shell casing. The herein invention in the exemplary form is an improvement on the mechanism of the inventor's earlier patent.

Other known prior patents of which knowledge is had include U.S. Pat. Nos. 2,550,827; 3,386,329; 3,808,939; 4,157,053; and 4,151,931.

It is known in the prior art to provide mechanisms to receive a measured charge of powder from a hopper and for delivering and dispensing the charge to a chute or other means for feeding the powder into a shell casing. It is known in the prior art to provide a movable member having a hole or opening in which a charge of powder is received from the hopper and also for providing mechanism for adjusting the size of the hole or aperture for the purpose of adjusting the size or volume of the charge of powder to be delivered to the shell casing. A deficiency of the prior art is that the size of the receiving hole or opening that receives the charge of powder is subject to variation because of loosening of the lock nut or otherwise so that the size of the charge of the powder can vary without the knowledge of the operator. In the interests of complete safety, such situation cannot be tolerated. Of course, the amount or size of the charge of powder admitted into a shell casing must be known and must conform to the specification for that particular size or caliber of shell for reasons of safety since otherwise an unexpectedly heavy explosion may occur.

The herein invention as described in detail hereinafter provides an improved mechanism which fully overcomes the deficiency of the prior art and achieves the desired degree of safety in the charge receiving and dispensing mechanism.

SUMMARY OF THE INVENTION

A preferred form of the invention is briefly described in the abstract.

Although a preferred utilization of the invention as described herein is in connection with or in association with a cartridge loading machine, it is to be understood that the principles and mechanism of the invention may be utilized in other combinations where it is desired to receive a measured charge of powder or similar material and to deliver it to another point under circumstances such that the size or volume of the amount or charge of material is very accurately and safely controlled.

In the exemplary form of the invention as referred to in the Abstract, the invention takes the form of a slider movable in a way underneath a powder delivery hopper. Formed in the slider is a longitudinal slot with a secondary slider in it mounted on a threaded stem or lead screw which passes through a rotor member rotatably mounted upon an axis transverse to the slot. The powder receiving hole is between the end of the secondary slider and the end of the slot. An elongated nut member extends through a hole in the slider and can be threaded onto the lead screw to lock it. The elongated nut can be unthreaded so that the secondary slider and rotor member can be rotated around its axis and then the secondary slider and threaded member can be turned or rotated relative to the rotary member so that the relative position of the secondary slider in the slot is adjustable. With this arrangement, the position of the secondary slider and necessarily the size of the receiving hole is fixed, insuring complete safety. The hole can be adjusted only be removing the elongated nut and then moving the secondary slider out of the slot.

In the light of the foregoing, the primary object of the invention is to overcome the deficiency previously existent in feed mechanisms such as powder feed mechanisms wherein a predetermined charge of powder or the like is received from a hopper and transferred for delivery to a shell casing or the like.

A further object is to overcome the said deficiency by way of the provision of a mechanism whereby the powder receiving hole or aperture is made adjustable by way of safety means whereby the size of the hole cannot get out of adjustment and can only be adjusted by predetermined manipulations by the user.

A further object is to realize a mechanism as in the foregoing embodying a slider having a slot with a secondary slider forming a powder receiving hole, with the slider being so mounted it can only be adjusted by being moved out of the slot in which it moves and rotated relative to a rotary member mounted on an axis transverse to the slot.

Further objects and additional advantages of the invention will become apparent from the following detailed specification and drawings.

DESCRIPTION OF THE PREFERRED EMBODIMENT AND BEST MODE OF PRACTICE OF THE INVENTION

The exemplary form of the invention as described in detail herein may be embodied in a cartridge loading machine like that of the prior U.S. Pat. No. 4,020,737 which is hereby incorporated herein by reference.

However, the improvement of the invention might be embodied in other types of mechanisms.

Figure 1:
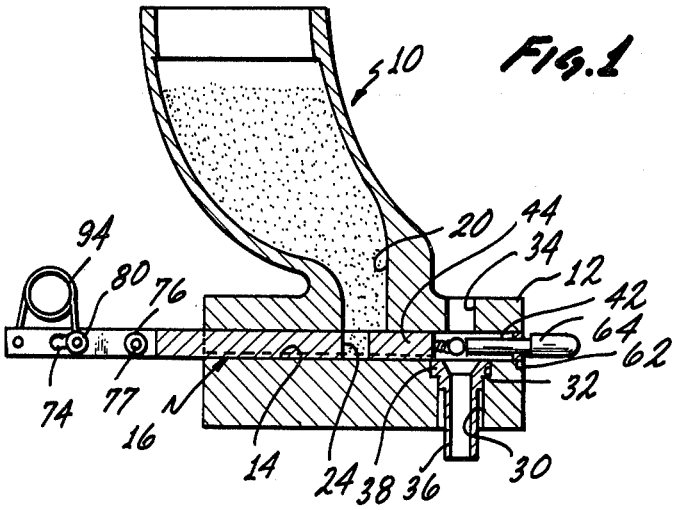
FIG. 1 is a sectional view of a powder hopper having the invention associated therewith.

Referring to FIG. 1 of the drawing, numeral 10 designates a hopper for powder or like material, the hopper being of a type that might be used in a cartridge loading machine. Numeral 12 designates a base part of the hopper. The part 12 has a channel or way 14 in it in which is received a slider or sliding member designated generally by the numeral 16. The slider or sliding member 16 is shown more in detail in FIGS. 2–7.

At the bottom part of the hopper 10 there is formed a narrowed neck or channel 20 into which the powder can feed into a powder receiving opening or hole 24 that is formed in the slider or sliding member 16 which opening or hole is adjustable as will be described. The powder can feed from the neck 20 into the hole 24.

Formed in the part or portion 12 is a bore 30 at the upper end of which is a counterbore 32 which is directly underneath a part of the way or channel 14. Numeral 34 designates a small bore that is coaxial with the bore 30 above the channel or way 14. Numeral 36 designates a powder receiving tube having an end part 38 of larger diameter that is received in the counterbore 32 as shown in FIG. 1. As will be described presently, the sliding member 16 is movable so that the powder receiving hole or opening 24 can be brought over the mouth of the tube or chute 36 for dispensing or discharging powder into the tube or chute for delivery to a cartridge casing to be loaded or to some other appliance as may be appropriate.

Figure 2:
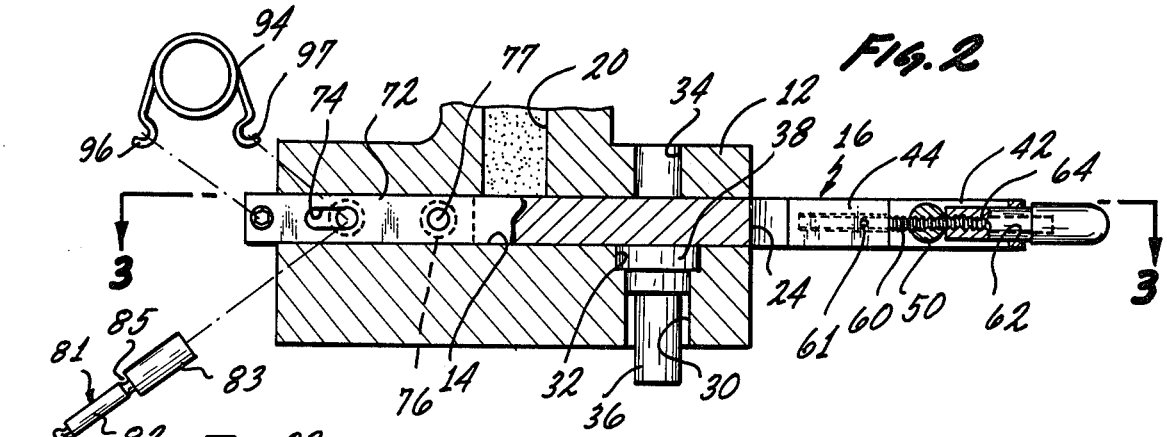
FIG. 2 is an enlarged partial by disassembled view of the lower part of FIG. 1.
Figure 3:
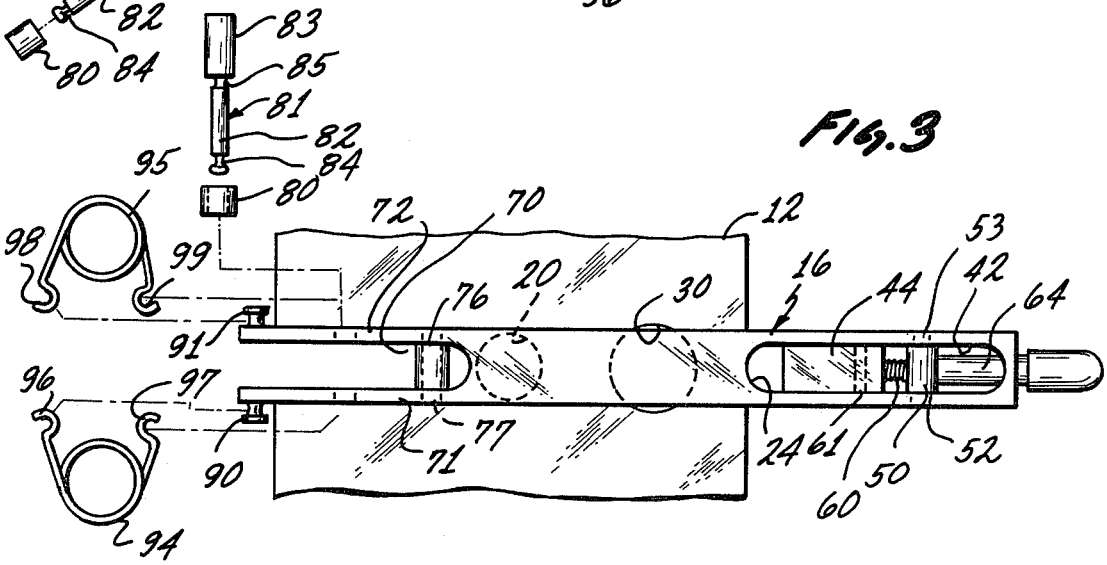
FIG. 3 is a partially disassembled plan view of the sliding mechanism of FIGS. 1 and 2.

FIGS. 1, 2, and 3 show the sliding member 16 assembled or partially with respect to the hopper 10 and delivery chute 36. As may be seen in FIGS. 4–7 the sliding member 16 is elongated and rectangular in cross-section, the channel or way 14 being of the same shape to receive it. At one end of the sliding member 16 is an elongated slot 42 the ends of which are arcuate as shown. Numeral 44 designates a secondary slider which may be substantially square in cross-section to slidably fit in slot 42. The charge receiving opening as designated at 24 is formed in between on end of the secondary slider 44 and the arcuate end of the slot 42. It is adjustable as described.

Numeral 50 designates a rotor or rotor bushing which is mounted in the slot 42 on trunions 52 and 53 so as to be rotatable. The rotor 50 has a threaded hole through it parallel to the center of the slot 42 and extending through this threaded hole is a stem or lead screw 60 which is threaded into a bore in the end of the secondary slider 44 as shown. Slider 44 is pinned to stem 60 by pin 61.

In the end of the sliding member 16 is a hole or bore 62 through which an elongated nut 64 can be extended, the nut having a threaded bore so that it can thread onto the stem or lead screw 60. Locking of the elongated nut 64 should be with contact with rotor 50 as shown in FIG. 6.

Figure 6:
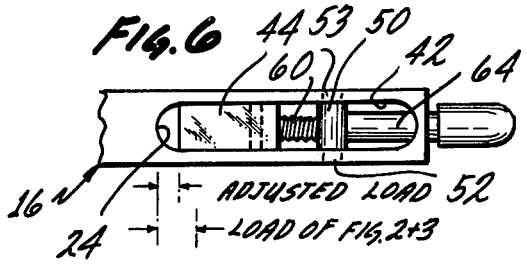
FIG. 6 is an illustrative view illustrating the adjustment of the secondary slider in the slot in the sliding member.

FIG. 6 illustrates adjusted positions of the secondary slider 44 which adjusts the size of the powder receiving hole or opening 24.

Figure 4:
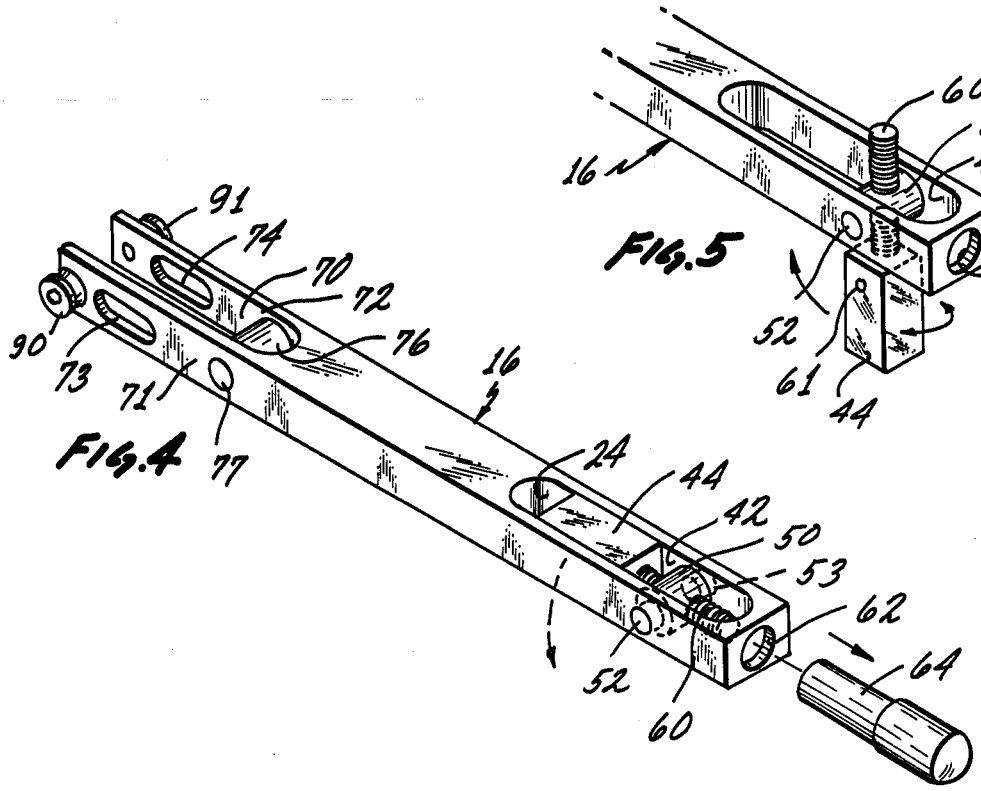
FIG. 4 is an isometric view of the sliding member in which the powder receiving hole is formed.
Figure 7:
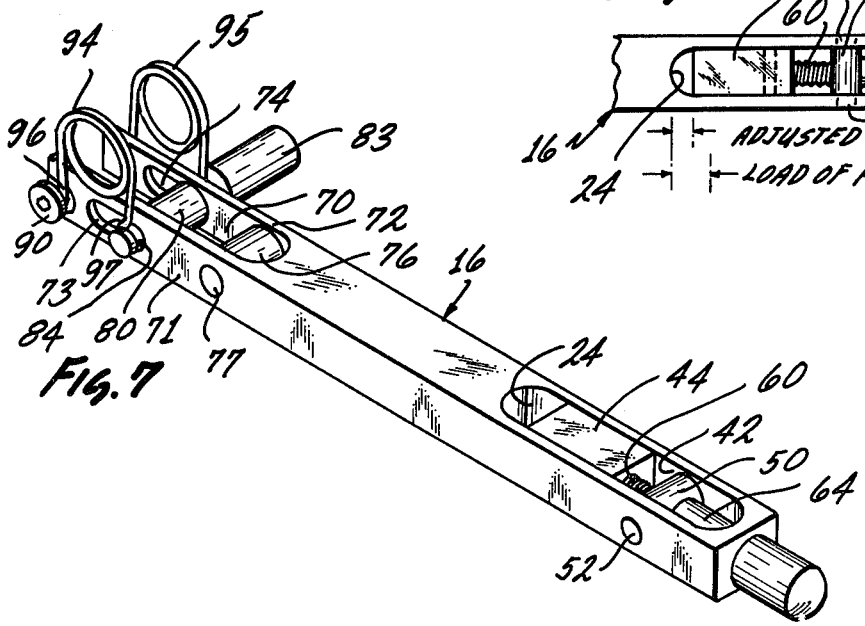
FIG. 7 is an assembled isometric view of the sliding member which forms the powder receiving hole.

FIGS. 4 and 7 illustrate in detail the construction at the opposite end of the slider member 60. The other end of the member 16 is slotted or bifurcated as shown at 70. Thus there are formed two legs 71 and 72 each of which has in it a slot or opening, these slots being designated at 73 and 74. Numeral 76 designates a roller that is mounted in the slot 70 being journalled on a pin 77.

Numeral 80 designates a second roller which is similarly mounted in the slot 70 spaced from the roller 76. The purpose of these rollers is that normally in a cartridge loading machine a notched bar is extended upwardly between the rollers. In such a combination the hopper assembly is part of a head that can be moved vertically and when this happens one of the rollers co-operates with the notches in the bar that is between them so as to reciprocate or agitate the slider 16 to assure that the powder in the powder receiving hole will be dispensed from into the chute 36. This same agitating action of bar 16, when powder receiving hole 24 is aligned with channel 20 will insure a uniform charge of material in receiving hole 24.

The roller 80 is journalled on a stem 81 which is shown more in detail in FIG. 3. The stem has an intermediate part 82 on which the roller is journalled and at one end is a portion 83 of larger diameter which forms a handle whereby the sliding member 16 can be manually reciprocated. Near one end of the stem 81 is a groove 84 and between the parts 82 and 83 is a groove 85. The grooves come into a position just on the outside of the legs 71 and 72 as may be seen in FIG. 7. At the ends of legs 71 and 72 on the outside of each are positioned grooved nuts as designated at 90 and 91. The purpose of these two nuts is to accommodate a pair of coil springs designated at 94 and 95. Spring 94 has end parts forming hooks as designated at 96 and 97. Spring 95 has end parts forming hooks as designated at 98 and 99. Spring 94 is positioned with its hook 96 hooked over the nut 90 with hook 97 hooked over the groove 84 of stem 81. Spring 95 is positioned with its hook 98 hooked over or into the groove of nut 91 and hook 99 is hooked into the groove 85 of member 81.

The springs 94 and 95 normally urge the pin 81 against the ends of the slots 73 and 74. Thus, the spring biased mounting or positioning of the pin 81 allows it to move in the slots 73 and 74 during reciprocation of the sliding member 16.

FIG. 1 shows the sliding member 16 in a position with the powder receiving hole 24 underneath the neck 20 of the hopper 10 to receive the powder.

Figure 5:
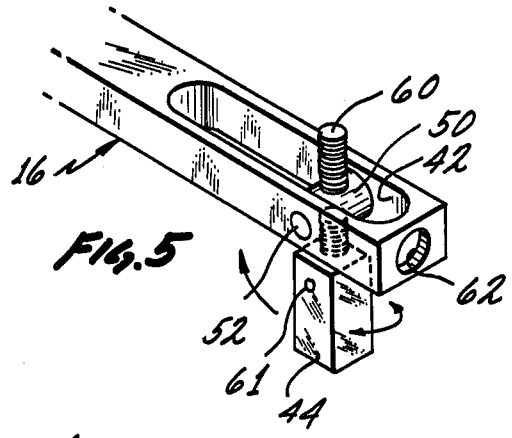
FIG. 5 is a partial isometric view of one end of the sliding member of FIG. 4.

The manner of adjusting the size of the powder receiving hole will be understood from FIGS. 2, 3 and 4–7. To make the adjustment the springs 94 and 95 are removed from their positions as shown in FIG. 7. The pin 81 is removed as illustrated in FIG. 2. The sliding member 16 can then be slid to the right in its way 14 to a position as illustrated in FIGS. 2 and 3. The elongated nut 64 is then removed from the lead screw 60 and the secondary slider 44 can be swung out of the slot 42 with the rotor 50 rotating as illustrated in FIG. 5. Then merely by rotating the secondary slider 44 about the axis of the lead screw 60 a fine adjustment can be made as to the size of the powder receiving hole, that is, the distance between the end of the secondary slider and the arcuate end of the slot 42. The secondary slider is then moved back into the slot 42 and its position is then again locked by threading the elongated nut 64 onto the lead screw 60. Thus, it will be seen that although a very fine and accurate adjustment can be made in the powder receiving hole, absolute safety is assured because the size of the hole cannot get out of adjustment; it can only be adjusted by the procedure as just described.

After making the adjustment the sliding member 16 is moved back into a position as illustrated in FIG. 1 with the stem or pin 81 replaced and the springs 94 and 95 put back into position.

From the foregoing, those skilled in the art will readily understand the nature and construction of the invention and the manner in which all of the objects as set forth in the foregoing are realized.

The foregoing disclosure is representative of a preferred form of the invention and is to be interpreted in an illustrated rather than a limiting sense, the invention to be accorded the full scope of the claims appended hereto.

What is claimed is:

1. In apparatus for measuring and dispensing flowable material; in combination, a member having a channel formed in it, a sliding member constructed to slide in the channel, there being a receiving opening for dispensed material, the first member having a passageway for conducting material to the receiving opening, mechanism for adjusting the size of the receiving opening, the sliding member having a slot having an end in it, the mechanism including a secondary slide member having an end positioned in the slot whereby the receiving opening is formed between the end of the slot and the end of the secondary slide member, means holding the secondary slide member whereby its position can be adjusted to adjust the size of the said receiving opening and means for locking the adjusted position of the secondary slide member, said holding means being constructed so as to require movement of the secondary slide member out of the slot for adjustment, and means for dispensing from the receiving opening, the secondary member having pivotal mounting in the slot whereby it can be swung laterally out of the slot.

2. Apparatus having a powder hopper that has a powder discharge passage in combination, a powder measuring and dispensing apparatus for measuring charges of powder including means providing a slideway, a sliding member slideable in the slideway and having an opening positionable to register with the end of the said discharge passage, the said sliding member including a channel having a secondary slideable member carried by it in the channel, the end part of said channel forming said opening, means within said channel for locking the secondary slideable member in position, said last means including a threaded member, a threaded stem engaging with said secondary slideable member and threaded member, the said channel opening to one side, the said secondary slideable member and threaded stem being pivotally mounted whereby to be movable outwardly laterally through said channel opening for adjustment of the secondary slideable member to adjust the size of said opening.

3. In apparatus for measuring and dispensing flowable material; in combination, a member having a channel formed in it, there being a receiving opening for dispensed material, a sliding member constructed to slide in the channel, the first member having a passageway for conducting material to the receiving opening mechanism for adjusting the size of the receiving opening, the sliding member having a slot having an end in it, the mechanism including a secondary slide member having an end positioned in the slot whereby the receiving opening is formed between the end of the slot and the end of the secondary slide member, means holding the secondary slide member whereby its position can be adjusted to adjust the size of the said receiving opening and means for locking the adjusted position of the secondary slide member, said holding means being constructed so as to require movement of the secondary slide member out of the slot for adjustment and means for dispensing from the receiving opening, said holding means including a threaded member engaged by the secondary slide member, a second threaded member having engagement with said first threaded member positioned whereby the secondary slide member can be moved out of the slot and rotated adjusting its position in the slot.

4. Apparatus as in claim 3 the locking means including an elongated nut engagable with the first threaded member for locking its position.

5. Apparatus having a powder hopper that has a powder discharge passage in combination, a powder measuring and dispensing apparatus for measuring charges of powder including means providing a slideway, a sliding member slideable in the slideway and having an opening positionable to register with the end of the said discharge passage, the said sliding member including a channel having a secondary slideable member carried by it in the channel, the end part of said channel forming said opening, means within said channel for locking the secondary slideable member in position, said last means including a threaded member, a threaded stem engaging with said secondary slideable member and threaded member, the said channel opening to one side of said slideway, the said secondary slideable member and threaded stem being movable outwardly through said channel opening for adjustment of the secondary slideable member to adjust the size of said opening, said threaded member being mounted to be rotatable with respect to said sliding member to accommodate movement of the secondary slideable member and threaded stem outwardly through the said channel opening for adjustment, a lock member extending through an end part of said slideable means and positioned in axial alignment with said threaded stem whereby it can be threaded onto an end of said threaded stem to lock it to prevent misadjustment of the said secondary slideable member.

* * * * *